United States Patent [19]

Treu

[11] 4,225,268

[45] Sep. 30, 1980

[54] BREAKWATER PIER APPARATUS

[76] Inventor: Johannes J. Treu, 1110 Camino Village Dr. #2624, Houston, Tex. 77058

[21] Appl. No.: 49,490

[22] Filed: Jun. 18, 1979

[51] Int. Cl.[3] ..... B63B 35/00; E02B 3/06

[52] U.S. Cl. ..... 405/27; 114/263; 405/31; 405/219

[58] Field of Search ..... 405/26, 27, 31, 35, 405/218, 219; 114/263

[56] References Cited

U.S. PATENT DOCUMENTS

| | | | |
|---|---|---|---|
| 1,397,025 | 11/1921 | White | 405/27 |
| 2,928,250 | 3/1960 | Smith | 405/27 X |
| 3,952,521 | 4/1976 | Potter | 405/27 |
| 4,070,980 | 1/1978 | Shorter | 114/263 |
| 4,123,185 | 10/1978 | Hagen et al. | 405/219 X |

*Primary Examiner*—David H. Corbin
*Attorney, Agent, or Firm*—Gunn, Lee & Jackson

[57] ABSTRACT

A breakwater pier apparatus is disclosed in the preferred and illustrated embodiments. The two embodiments utilize a framework floated in the water by buoyant tanks therein, the apparatus including a rearwardly sloping wave energy absorbing wall adapted to float partly underwater and partly above the surface of the water and facing the direction of the wave action, this wave energy absorbing wall being slotted to intercept part of the wave action to create a force tending to hold the breakwater in vertical position. The framework includes an upright wall which also floats partly out of the water. Appended to the wall is a set of floating stub piers for individual boat anchorages. The apparatus is tethered or guided on an upstanding piling.

10 Claims, 4 Drawing Figures

FIG. 1
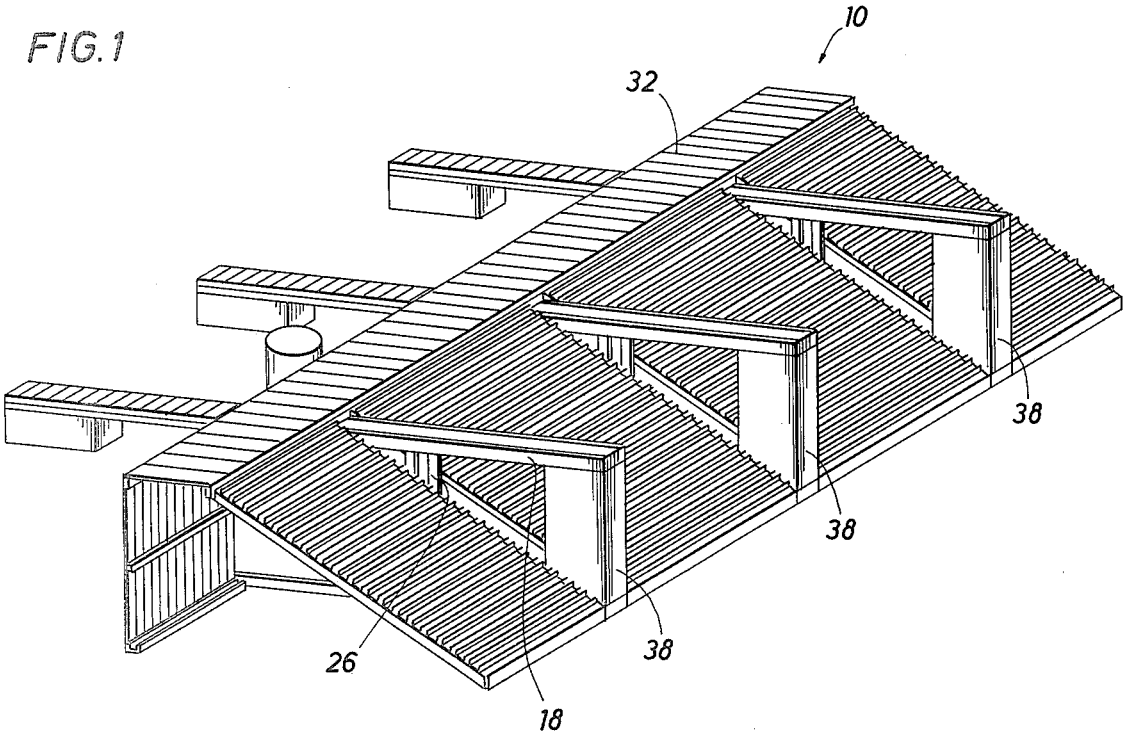
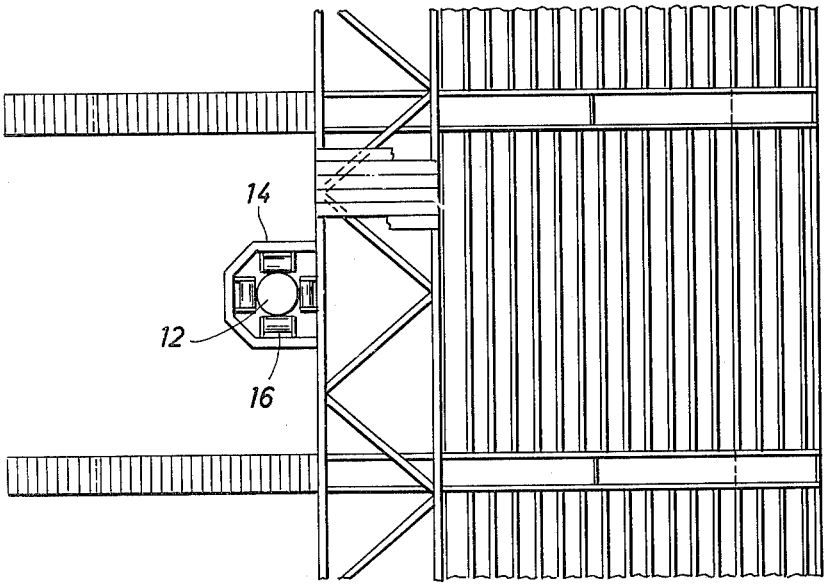
FIG. 2

BREAKWATER PIER APPARATUS

BACKGROUND OF THE DISCLOSURE

Breakwater devices of all types, sizes and shapes have been devised heretofore. In many instances, it is permissible to build or erect a stone, rock or mud embankment to serve as a breakwater. This is not usually feasible if the bottom is quite deep. When the water is deep, the depth of the water militates against construction of a bottom supported breakwater. If cost is no object, it is possible to build fixed, framed structures which are bottom supported to serve as a breakwater, even in deep water. A framework can be erected on upstanding pilings and the like. However, this also has a limitation which is, in part, related to its cost and complexity and another limit which is also related to its fixed nature. If the tidal fluctuations are sizable, the rise and fall of the tide may completely submerge the apparatus, or, otherwise, the framework will stand taller than the largest expected wave.

The present invention, however, is different from the foregoing structures. It is a floating breakwater apparatus. It floats at a tethered location and is, therefore, always positioned at the top of the water at an elevation selected to break up the wave action even up to the largest expected wave. This top water location is advantageous in that it is able to break up the wave action of any size wave up to the maximum expected wave crest. It is the kind of breakwater that can easily be deployed around a yacht basin or the like. Moreover, it avoids cost limitations intrinsically found in fixed breakwaters in deep water. They are usually so expensive that a small craft marina cannot afford their cost.

At some coastal locations, it is hard to find a usable and accessible yacht basin location which will shelter a number of small vessels. Small vessels particularly include sportscraft, fishing boats, commercial shrimpers, sailboats for pleasure and the like. These small boats are typically berthed together at a yacht basin which should be ideally close to the open water and, yet, which should be out of the traffic of larger vessels. Since larger vessels command so much more area in a bay or harbor, the pleasure craft and other small boats are sometimes left begging. The present invention assists in construction of yacht basins for innumerable small craft at locations not otherwise usable as yacht basins.

The present apparatus is superior to floating pontoon breakwaters. This type of breakwater is somewhat transparent to the wave front. While a wave is visible as a top located crest and valley, its energy also extends well below the water surface, having a depth of many meters. The wave energy is distributed from top to bottom in a known relationship. The energy of the wave is not fully and effectively intercepted by a floating pontoon breakwater. Rather, the portion of the wave passing beneath the floating pontoon breakwater is sufficient to reconstitute a significant portion of the wave after passing beneath the breakwater. Simply removing the crest of the wave is inadequate to form a breakwater.

The fixed type of breakwater is sometimes a pollution trap. Sediment will enter the breakwater with a tidal change and thereafter settle to the bottom. This occurs in the breakwater area and collects until the sheltered area requires dredging. The breakwater of this invention overcomes this problem by permitting water to flow beneath it and into the breakwater area to keep it flushed. Sediment does not accumulate in a manner exceeding the rate of accumulation for the nearby area. The pollution and sedimentation problem mentioned above is, therefore, avoided.

BRIEF SUMMARY OF THE DISCLOSURE

The present invention is an apparatus which can be deployed in selected lengths to encircle a yacht basin. It not only provides breakwater protection to the interior of the yacht basin, but it also defines an outer wall around the yacht basin which defines a set of adjacent berths in it. The apparatus is particularly advantageous in that the yacht basin can be expanded or enlarged by merely adding more segmented sections of the present invention. It can be constructed in standard lengths as, for example, lengths which are easily constructed in a shop and deployed by ground transport, barge transport or floating on its own tanks away from the shop.

The present invention is particularly advantageous in that it defines the outer perimeter of a yacht basin by forming a set of boat slips or berths. The apparatus can be scaled to berth small craft within a wide range of dimensions and types. The small craft are berthed on the leeward side of the breakwater apparatus and are, therefore, in a becalmed area compared with the open water from which the waves originate.

The present apparatus can be scaled depending on requirements. It can be scaled to different dimensions depending on the expected wavelength and wave height. The apparatus which accomplishes this features a forwardly facing, sloping energy absorbing surface which is formed of a number of horizontal and spaced slats. They are spaced apart so that they are somewhat transparent to the impinging wave. The slats intercept the wave and convert energy in the wave into a downwardly directed force which more or less balances against the rise of the buoyant breakwater and thereby stabilizes the breakwater in the water. Moreover, they are supported at a sloping angle which tends to break up the wave action and stagger the rise of water which does pass through the open latticework. Behind the absorbing surface, the apparatus includes an upright, solid wall having the same height as the energy absorbing surface. The two terminate at a top located walkway. All of this is supported by a framework therebeneath and a set of buoyant sealed tanks. On the back side of the upright wall, the apparatus also carries stub piers which define a set of boat slips for small craft.

BRIEF DESCRIPTION OF THE DRAWINGS

FIG. 1 is an elevated perspective view of the breakwater apparatus of the present invention;

FIG. 2 is a plan view of the apparatus shown in FIG. 1, particularly illustrating an upright piling which guides the apparatus as it rises and falls on the water;

DETAILED DESCRIPTION OF THE ILLUSTRATED EMBODIMENTS

Figure 3:
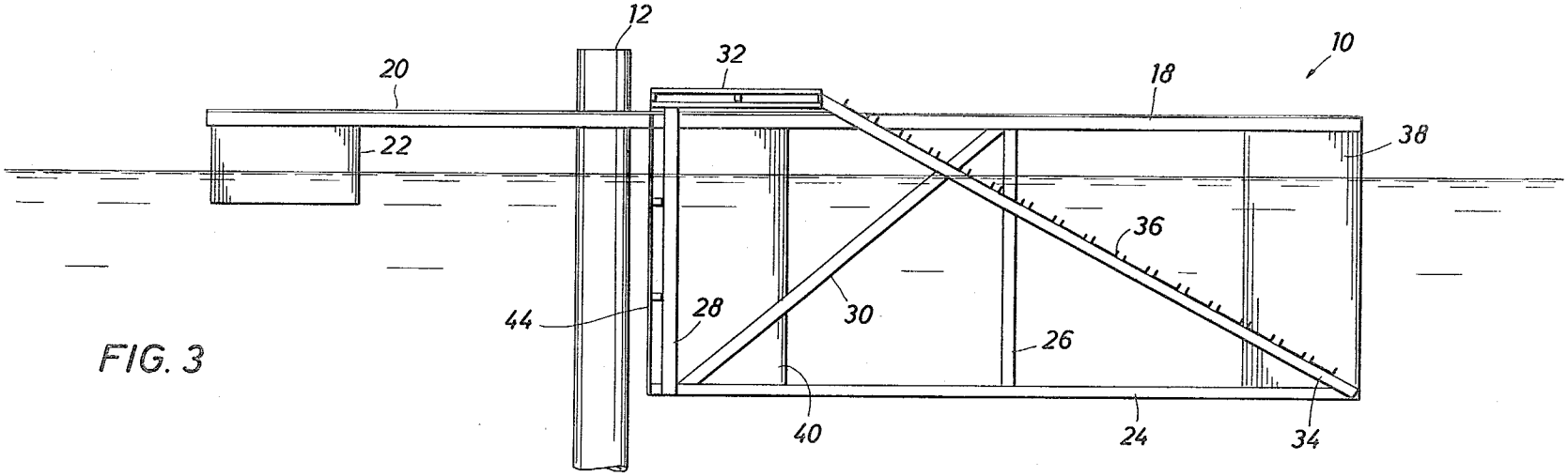
FIG. 3 is a sectional view through a first embodiment of the breakwater of the present invention showing details of construction.

In FIG. 1 of the drawings, the numeral 10 identifies the first illustrated embodiment of the breakwater of the present invention. It is to be deployed around the perimeter of a yacht basin. It has a sloping face which is directed towards the open water, and it has a sheltered back side which faces the yacht basin. It is, perhaps, better understood by referring jointly to FIGS. 1, 2 and 3. All of these views bring out certain structural features and advantages of the apparatus. In FIG. 3, as an example, an upstanding piling 12 serves as support structure which anchors the breakwater apparatus in a particular locale. Pilings are positioned at spaced locations along the length of the breakwater. They have sufficient height to guide the breakwater so that it is maintained in the same specific location, but the breakwater is permitted to rise and fall to accommodate routine variations in tide, high tides resulting from unusual weather disturbances and a limited rise and fall with waves. The piling is a mooring post; vertical movement is permitted by incorporating a surrounding ring 14 shown in FIG. 2. The ring 14 supports on its interior rollers 16 which are either rollers mounted on shafts or fixed guides having a smooth, low friction inner surface which abuts against the piling 12. Rise and fall of the breakwater apparatus 10 is thus permitted with tidal changes. As viewed in FIG. 3, the breakwater apparatus can rotate about its point of contact against the piling 12. Rotation through a limited and slight range of deflection permissibly occurs as the breakwater 10 rocks as a wave is absorbed. The right-hand edge as viewed in FIG. 3 will rise first on encountering the wave and eventually moves to a maximum elevation. Tilting of the apparatus as it rotates in a counterclockwise direction as viewed in FIG. 3 is limited. As the wave passes beneath the equipment, it first lifts the front edge in a clockwise direction. Simultaneously, the wave pushes the breakwater down and approximately offsets the buoyant force. Accordingly, some rotation and rise and fall of the breakwater 10 occurs. It is limited ideally to none. To this end, the rollers 16 need not snugly or firmly grip the piling 12. Rather, they are loosely fitted about it with some lateral movement permitted. A precisely aligned connection between the two is not necessary as a means to limit wave initiated rotation or bobbing motion.

In FIG. 3, the numeral 18 identifies a horizontal frame member supporting planking 20 which serves as a stub pier. While it has strength to support people on it, it is aligned above the water by a closed or sealed buoyant tank 22 sized to maintain the frame member 18 approximately horizontal in calm water as depicted in FIG. 3. The length of the frame member 18 can be varied; in addition, the frame member 18 can be varied in quantity and strength. In light of these variations, it will be understood that the deck planking 20 serves as a walkway which services boats which are moored to the stub pier.

The stub pier is something of an appendage to the main body of the apparatus. It is located on the leeward side which imparts shelter to it. This shelter is achieved through the remainder of the apparatus. A submerged frame member 24 is located along the bottom and is parallel to the frame member 18. They are joined together by an upstanding frame member 26 in the center and an upright frame member 28 at the rear. These frame members are cross-braced by angled braces 30. All of the braces, together, impart transverse structural rigidity to the breakwater 10. The upstanding frame member 28 connects to the bottom side of a plank walkway 32. This is better shown in FIG. 1 to comprise a lengthwise walkway. It is formed of a number of transverse planks, preferably slightly spaced so that there is a fractional slot for drainage. While it may be splashed and wet, water runs off quickly, and a safe passage for personnel is thereby defined, except in maximum storms. As will be observed in FIG. 3, the personnel can easily walk from the walkway 32 onto the stub piers 20 which are approximately equal in elevation. The various walkways can be equal in height or connected by steps or ladders.

The sectional view of FIG. 3 also discloses a rearwardly sloping frame member 34 supporting a number of horizontal, U-shaped channel members 36. They are spaced from one another as shown in FIG. 3. The channel members 36 positioned along the sloping plane face the impinging wave. The many channel members define a surface made of openings in a percentage range of about twenty-five percent to forty percent. The wave impact is greater when the openings are relatively reduced. Contact is first made at the lower portions, and the wave tends to ride up onto the channel members 36. The several channel members collectively arranged in this fashion serve as a wave action energy absorbing wall. The top of a wave is forced to ride up the wave energy absorbing wall. Some of the water and, hence, a portion of the wave will pass through the energy absorbing wall. This occurs more in the form of a gentle rise as opposed to a wave crest. This rise may elevate the breakwater 10 in the water if it is not balanced by a downward force created by wave impact. Thus, if the energy absorbing wall is 20.0 feet in height as viewed in FIG. 3, it will intercept the wave having an effective height of perhaps 15.0 or so feet. The energy absorbing wall intercepts the crest of the wave and breaks the wave up, forcing some of the wave to ride higher and higher, to create a downward force from that portion of the wave and permitting some portion of the wave to flow down through the slots between the adjacent channel members 36.

The channel members 36 extend along the full length of the apparatus with slots above and below each one. The frame member 18 extends above the wave energy absorbing surface. It supports an upstanding, buoyant tank 38 which connects to the bottom frame member 24. The buoyant tank 38 is relatively tall and narrow, perhaps 1.0 meter or less in width. The tank is preferably thin in front and side profile to avoid materially intercepting frontally or angularly arriving wave fronts. FIG. 1 shows that the tank 38 is duplicated at many locations. At each location, the tank stands upright and above the wave energy absorbing wall. A wave impinging on the breakwater 10 passes easily around the buoyant tanks shown in FIG. 1. Because the wave is not cut into segments totally disconnected from one another, they merge after passing the buoyant tanks and continue on as a unitary or single wave. When the wave impinges on the breakwater 10 from a direction which is not perpendicular to the breakwater, the wave is only slightly segmented and is still a single wave. In the event a wave strikes the breakwater at an angle, the force which is delivered by the wave to the breakwater does not occur at a single instance in time; the force is delivered as each portion impinges on the breakwater to prolong the downward reactant force on the breakwater.

Each tank 38 is supported by the horizontal frame members 18 which are included in sufficient quantity, arranged parallel to one another, to support the structure. As shown in FIG. 1, the frame members 18 align with the stub piers on the rear and the wave divider tanks 38 on the front of the apparatus. The frame member 26 is an upstanding frame member which extends above the energy absorbing wall shown in the drawings.

The numeral 40 identifies a second buoyant tank held in the upright position and which is approximately equal in buoyancy to the tank 38. The tanks 38 and 40, together, balance the breakwater apparatus in the water. Ignoring for the moment the stub pier, the breakwater is generally rectangular, and, through the deployment of approximately equal tanks at the left and right edges of the apparatus shown in FIG. 3, buoyancy is obtained which levels and stabilizes the apparatus. The tanks 38 and 40 need not be equal in size. The more desirable approach is that they jointly level and stabilize the breakwater.

The tanks are scaled to offset the weight of the apparatus. Sufficient buoyancy is created to maintain a portion of the apparatus above the surface. That portion of the breakwater which is above the water constitutes about twenty to thirty-five percent of the height of the equipment. This is a scale factor which can be varied somewhat. It is not desirable that the apparatus be substantially fully submerged. In opposite manner, it is not desirable to have fifty percent or more of the apparatus out of the water. While height might differ in peculiar circumstances, the optimum range of height above the water is about twenty to thirty-five percent of the height of the structure measured from the frame member 18 to the parallel bottom frame member 24. As will be understood, these are scale factors which prevail in the normal case. They may be altered depending on the depth of the water and the anticipated height of the waves. The framework can be enlarged in size to the extent that larger or additional tanks can be incorporated. Stability is enhanced by placing tanks in two relatively spaced rows to cut down on rotation of the breakwater.

FIG. 3 is a sectional view through the breakwater 10. The illustrated equipment is repeated as necessary at appropriate intervals. This defines the structure so that it has indefinite length. The tanks 38 and 40 are thus duplicated at spaced locations, and even the shortest breakwater segment includes two or more sets of tanks at spaced locations along its length. The apparatus has an indefinite length. The required length is preferably achieved by fabrication of different sections. They can be closely joined or can be positioned with gaps therebetween to serve as passages for small vessels. For a given breakwater length, the tanks are sized to minimize bobbing on the water as waves pass while floating at a specified depth to permit the breakwater to rise and fall with the tide. Tidal variations are accommodated, while wave action bobbing is suppressed by dynamically created forces arising from impact of the wave on the sloping wall to offset buoyant uplift of the breakwater.

It will be observed that the apparatus has a height which extends above the water to the walkway 32. A solid wall 44 is constructed just beneath it. This wall is just behind the energy absorbing wall, and it stands vertically. The energy absorbing wall is arranged at an angle in the range of 25.0 to 40.0 degrees relative to the horizontal. The angle, if shallow, requires excessive structure to achieve a specified height. The angle, if too steep, causes the energy absorbing wall to intercept the wave frontally with excessive impact and requires excessive structural strength to absorb the frontal force. The solid wall 44 has a height which is dependent on the height of the apparatus. A significant portion of it extends below the water to the bottommost frame member 24. Significant wave energy is beneath the wave valley. This enables the solid wall 44 to block the underwater energy that passes through or beneath the energy absorbing wall in front of it. Very litte wave energy passes over or under the solid wall. The wall 44 reflects wave energy back toward the sloping wall and creates an area of random turbulence between the two walls. The reflected waves cancel in random fashion and in random energy amounts.

It will be appreciated that there is a range of waves which the present invention can intercept and absorb. Waves larger than this may, in fact, pass over the apparatus. Larger waves which do pass over or under the apparatus are still partially interdicted and reduced in amplitude. Reduction of wave height and wave action is thus achieved, even for very large waves, those which pass over the breakwater 10. There is a design maximum which can be determined for a given locale which is dependent on many factors. This maximum sets out the maximum for a given storm severity, such as a 100-year storm (the largest storm expected in 100 years). While a portion of the wave may pass around the apparatus in some circumstances, the wave becomes a good deal more gentle and is significantly reduced in wave height and energy.

Figure 4:
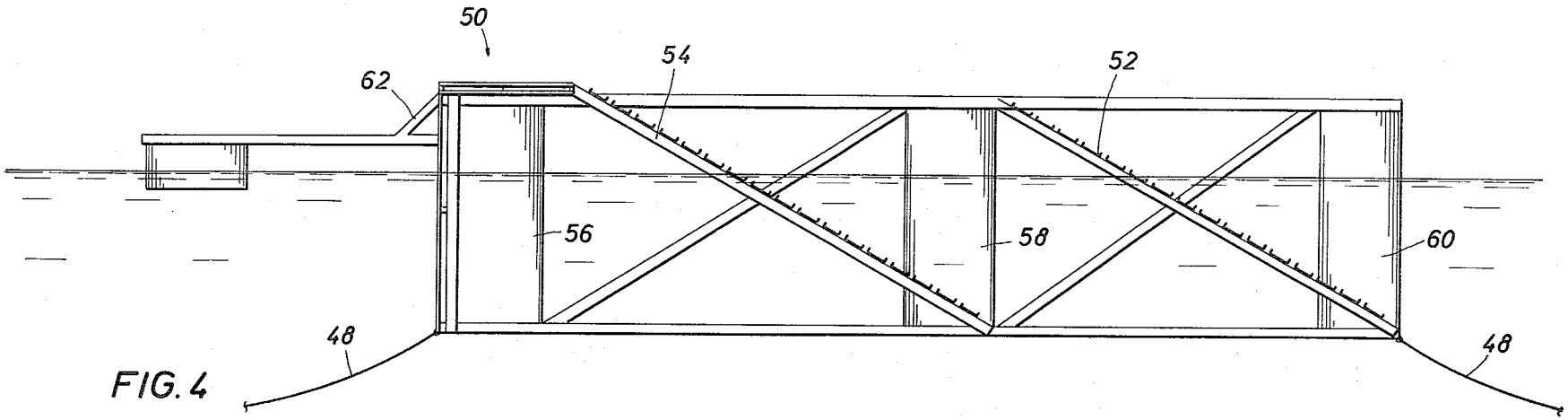
FIG. 4 is a sectional view similar to FIG. 3 illustrating details of construction of an alternate embodiment having two forwardly sloping energy absorbing surfaces and further showing an alternate mooring arrangement.

FIG. 4 shows an alternate embodiment differing in two regards. First of all, the mooring post 12 is omitted. The apparatus is anchored with underwater cables or chains 48 which are connected to suitable bottom anchors. The cables can connect, by way of example, through an eyelet to a concrete foundation which is anchored to the bottom. Cables are deployed with some slack to enable the breakwater to move slightly to the right and left and also to rise in the water. The number of cables is subject to variation. The cables are deployed at some angle as depicted in FIG. 4. This angle is a scale factor which can be varied over a wide range. The cables 48 are thus substituted in place of the piling 12. The breakwater can be deployed from shore to shore as, for example, across a narrow inlet or neck of water. The span between pilings is a scale factor which, again, can be varied. In like manner, cables can be located only at the ends of the equipment, provided the span in between cables is not too great. The piling 12 and the cables 48 are all used to anchor the equipment at a designated location, and the extent, measure and quality of anchoring is variable within limits depending on the circumstances and conditions at the point where the breakwater is installed.

FIG. 4 depicts an alternate embodiment 50 which is very similar to the breakwater 10, except that it includes first and second energy absorbing walls at 52 and 54. They are preferably similar to one another in that they are made of the same materials, have approximately the same angle of inclination relative to the level of the water, are made of the same channel-shaped members and are deployed where one intercepts the wave first and the other intercepts it after the first one. The use of double energy absorbing surfaces absorbs the wave action more successfully. As a general rule, the front wave energy absorber means has a greater percentage opening area of perhaps forty percent or so of the total surface. The back sloping wall has a reduced opening area, perhaps being twenty to thirty percent of the total surface area. It requires an extension of the framework in comparison with the structure shown in FIG. 3. It also requires and utilizes a wider framework for the breakwater construction. As the framework becomes wider, it becomes helpful to spread the buoyant tanks apart, and, to this end, FIG. 4 shows three tanks 56, 58 and 60 across the encompassing an increased width. These tanks, again, are sized, scaled and so located to elevate a selected portion of the apparatus above the body of water. Again, the included stub pier is constructed in the same manner as shown in FIG. 3, except that it may vary in height and require steps on the riser 62. This, again, is a scale factor, and steps can be added or omitted as necessary. Normally, the stub pier is arranged at a height of about 0.50 to 0.80 meters above the water level.

Wavelength is more important in breakwater design than wave height. As the ratio of wave length to wave height increases, the relative width of the framework increases and more readily justifies the two sloping wall arrangement of FIG. 4. One wall deployed in an extra wide framework would have a shallow angle; two walls in the same framework have more acceptable angles. Effective width is increased to overcome waves with long wave length.

Construction materials suitable for the present invention are preferably water-proofed, either being treated wood or aluminum framing members. In the alternative, painted or galvanized steel can be used. The tanks can be formed of treated sheet metal or fiberglass, provided the gauge of material is sufficiently strong to resist the pounding of the sea. They are preferably foam filled to reduce maintenance.

The channel members 36 which define the energy absorbing walls are preferably formed with upstanding lips or tabs along their full length which stand about 1.0 to 10.0 centimeters tall. They can be taller, but, if so, they require some reinforcing to limit bending which occurs with the impact of water against them. The gauge of material used in the channel members 36 is thus dependent on a number of scale factors including the number and placement of braces 34 which are positioned beneath it and the fasteners used to anchor the channel members.

The foregoing is directed to the preferred embodiment, but the scope of the present invention is determined by the claims which follow.

I claim:

1. A breakwater which comprises:

(a) a framework deployable in a body of water;

(b) buoyant means supported by said framework, said buoyant means imparting a selected flotation to said framework;

(c) wave energy absorbing means comprising a surface facing the impinging waves arriving at the breakwater and which (1) is a sloping surface;

(2) is formed of a facing member having openings therein;

(3) is supported by said framework partly above the surface of the water; and (4) has a length corresponding to the length of the breakwater;

(d) said buoyant means and framework supporting said wave energy absorbing means floating in the water to rise and fall with the tide within a specified range; and (e) a solid wall supported by said framework and which (1) is spaced behind said wave energy absorbing means;

(2) has a height approximately equal to the height of said wave energy absorbing means; and (3) is approximately coextensive to said wave energy absorbing means.

2. The apparatus of claim 1 including a generally horizontal walkway along the top portions of the breakwater which walkway is supported by said framework and is above and parallel to said wave energy absorbing means.

3. The apparatus of claim 2 including a generally perpendicular pier extending from said walkway on the leeward side of the breakwater, said pier supported by said framework and said buoyant means above the water to define a sheltered berth for vessels adjacent to the breakwater.

4. The apparatus of claim 3 wherein said framework includes an elongate, horizontal frame member comprising a portion of said pier and wherein said frame member extends forwardly toward the windward side of said framework and above said wave energy absorbing means to position and support a tank comprising a portion of said buoyant means.

5. The apparatus of claim 4 wherein a closed, buoyant tank comprises at least a portion of said buoyant means.

6. The apparatus of claim 1 wherein said buoyant means comprises two or more tanks deployed on said framework to float said framework and maintain said framework at a desired angular position in the water.

7. The apparatus of claim 6 including tether means limiting horizontal movement of the breakwater in the water.

8. The apparatus of claim 7 wherein said tether means comprises flexible means adapted to extend toward bottom located anchors.

9. The apparatus of claim 7 wherein said tether means comprises an upstanding piling and guide means engaged with said piling which guide means is supported by said framework.

10. The apparatus of claim 1 wherein said wave energy absorbing means comprises a set of U-shaped members having upturned lips spaced from one another, said U-shaped members spaced to define lengthwise slots therebetween and further including a framework member therebehind supporting said U-shaped members to intercept impinging wave action; and further wherein said wave energy absorbing means is arranged at an angle between about 25.0° and 40.0° relative to the horizontal and rises toward the back edge to be partially positioned out of the water with the front edge positioned in the water.

* * * * *